US007770866B2

(12) United States Patent
Ferro De La Cruz

(10) Patent No.: US 7,770,866 B2
(45) Date of Patent: Aug. 10, 2010

(54) DEVICE FOR THE ALIGNMENT OF MODULAR FORMS IN CONCRETE WALLS

(76) Inventor: Juan Antonio Ferro De La Cruz, Av. Insurgentes sur 1673, despacho 603, Col. Guadalupe Inn, Delegacion Politica Alvaro Obregon, Mexico (MX) 01020

( * ) Notice: Subject to any disclaimer, the term of this patent is extended or adjusted under 35 U.S.C. 154(b) by 0 days.

(21) Appl. No.: 12/282,951

(22) PCT Filed: Apr. 28, 2006

(86) PCT No.: PCT/MX2006/000027

§ 371 (c)(1),
(2), (4) Date: Sep. 15, 2008

(87) PCT Pub. No.: WO2007/108670

PCT Pub. Date: Sep. 27, 2007

(65) Prior Publication Data

US 2009/0056273 A1 Mar. 5, 2009

(30) Foreign Application Priority Data

Mar. 17, 2006 (MX) ..... PA/A2006/003044

(51) Int. Cl.
*E04G 17/14* (2006.01)

(52) U.S. Cl. ..... 249/216; 52/698; 249/209

(58) Field of Classification Search ..... 264/31, 264/32, 297.9, 333; 425/63, 64, 65; 249/1, 249/2, 3, 4, 5, 6, 189, 192, 193, 207, 209, 249/216; 52/698, 749.1
See application file for complete search history.

(56) References Cited

U.S. PATENT DOCUMENTS 1,699,557 A 1/1929 Yeager (Continued)

FOREIGN PATENT DOCUMENTS

DE 2710224 A * 9/1978

(Continued)

OTHER PUBLICATIONS

Callister, Materials Science and Engineering An Introduction, 2003, John Wiley and Sons Inc, Sixth Edition, pp. 199-201.*

*Primary Examiner*—Joseph S Del Sole
*Assistant Examiner*—Timothy Kennedy
(74) *Attorney, Agent, or Firm*—Kevin W. Grierson, Esq.

(57) ABSTRACT

The present invention relates to a device for the correct alignment of forms structures for the pouring of concrete walls, the device has guide elements and assists the operator in the correct positioning thereof and fastening thereof on the layouts that it is customary to mark out on the foundation template for the raising of walls; it is a body of a single piece, produced form a plastic resine. The configuration of the device of the invention allows an operator manually or using a pneumatic gun to fasten a plurality of devices, in order to align the center "walls" so that they are parallel to one other, such that the planned thickness of the wall, corresponding to the width of the device, can be guaranteed in the section included between the guide devices. On account of its design and the material which it is produced, the device functions suitably with the form, the concrete and the reinforcing steel.

6 Claims, 13 Drawing Sheets

U.S. PATENT DOCUMENTS

| | | | | |
|---|---|---|---|---|
| 1,816,226 | A | 7/1931 | Krabiel | |
| 2,182,579 | A | 12/1939 | Bolton et al. | |
| 2,378,850 | A * | 6/1945 | Hyre | 249/210 |
| 3,618,888 | A * | 11/1971 | Wise | 249/10 |
| 4,330,971 | A | 5/1982 | Auberger | |
| 4,614,070 | A | 9/1986 | Idland | |
| 4,724,642 | A | 2/1988 | Hoffman et al. | |
| 4,736,544 | A | 4/1988 | Greenquist | |
| 5,125,616 | A * | 6/1992 | Rothenbuehler et al. | 249/3 |
| 2004/0084603 | A1 * | 5/2004 | Latham | 249/188 |

FOREIGN PATENT DOCUMENTS

| | | | |
|---|---|---|---|
| FR | 2631063 | A1 * | 11/1989 |

* cited by examiner

DEVICE FOR THE ALIGNMENT OF MODULAR FORMS IN CONCRETE WALLS

TECHNICAL FIELD

This invention is related with the devices for the correct alignment of the modular forms or panels or frames used for "casting" or "pouring" the concrete walls, such as those used for serial housing and other kinds of constructions.

BACKGROUND OF THE INVENTION

For the construction of houses, it is common for walls to be manufactured in site, using materials such as concrete, which is poured into the form or frame or contention structure, which at the same time will rest on an layout or template or foundation template which conforms the base of the construction.

The distribution of the walls to be poured is made through a layout, sketched over the pattern or foundation template, according with the blueprints of the construction.

In order to perform the pouring, it is necessary to erect temporal walls like frames or forms, which shall be perfectly aligned in order to guarantee a constant concrete thickness in the walls to be constructed.

The alignment of this kind of modular forms or frames, which are vertical in most cases, has been an aspect directed from several perspectives. Some of the alternatives of the prior art include the following:

The U.S. Pat. No. 1,699,557 (Yeager, 1929) describes a device for fastening and leveling of wooden floors on concrete bases, such device is fastened in the concrete base by projections imbibed in the concrete before setting so after that, the floor supports can rest directly over the already fixed device. As well, the U.S. Pat. No. 1,816,226 (Krabiel, 1931) illustrates a more simple embodiment of this kind of fastening devices, consisting of a "U" shaped metallic element which base (the lower part of the U) have holes to receive nails or similar means to fasten it on a support such as wood, and where both walls of the U rise perpendicularly and have holes to fasten these walls to a wooden piece which must be fasten. Another device which is similar from the functional point of view but having a different configuration is the one described in the U.S. Pat. No. 2,182,579 (Bolton, et al., 1939).

The U.S. Pat. No. 4,330,971 (Auberger, 1982), in the other hand, describes a device to "maintain the alignment" between a wooden floor plate and a wooden frame over the level of the first, which also works as a support which delimitate the frame. In this case, the device is fastened to the floor and to the wooden frame for support and alignment, using nails or screws which pass through the walls of the device.

The U.S. Pat. No. 4,614,070 (Idland, 1986), describes what is called a support shoe, which is a part to be built in a vertical position in a concrete foundation by a rod to which is attached through the lower area, the support have retainers which allow to form a fork when attaching two elements with "L" shape with holes in which the nails or screws are fixed to the lower part of the vertical plates or other object to be supported (like a post). The fork is adjustable to the width of the object to be supported.

In the U.S. Pat. No. 4,736,554 (Tyler, 1988) it is described a method and a device to locate and position several anchor bolts in concrete in order to provide a holding device for columns and posts. The device includes two or more anchor bolts which pass through the plate and are welded to a plate.

Another approximation to the alignment problem for walls is provided by the U.S. Pat. No. 4,724,642 (Hoffman et al, 1988) where a molded device has a plurality of projections and holes which open upwards, to form an anchor set for construction elements, for example walls or wall frames.

In some embodiments, downwards projections from the bottom of the device, which can be used for fastening are included.

In general, the solution includes the installation of a chute with a "U" shaped profile, which is fasten to the template or foundation template using nails or screws. As it can be observed, the use of such chute in the base of the wall may cause a series of basic problems between the wall and such template, for example allowing filtrations or cavities; or since we are dealing with ferrous materials, oxidation and pollution can be generated, reducing the resistance and life of the steel reinforcement of the concrete wall or damaging the lower area of the internal faces of the form or mold, most of all when dealing with soft materials such as wood or aluminum, reducing also the life of the form.

An alternative solution is the use of guide devices such as the above mentioned, made from plastic resins which location is restricted to some established points of the lower part of the wall or form, and in such way, the problem to be solved is to fix such devices in such a way that the correct alignment of the forming elements is guaranteed and therefore the alignment of the finished walls. This invention is related to one of these alignment devices.

OBJECTS OF THE INVENTION

In the light of the limitations and problems in the developments so far proposed in the prior art, it is an object of this invention, to provide a device to correctly align the form for a concrete wall to be poured.

Another object of this invention is to provide a device useful to establish or maintain the total thickness of a concrete wall.

It is another object of this invention is to provide a device which allows the settlement of the uniform distance which shall exist between each couple of opposite panels, in order to achieve the planned thickness of the concrete in the walls.

It is a further object of the invention, that the alignment device have elements which can be easily and rapidly fastened by the operation, even if the surface on which it will be placed is uneven (roughness).

It is yet another object of the invention, that the material and the geometric configuration of the device do not produce damages to the internal surfaces of the form when having contact with them.

Another object of this invention is that the material for the device shall not generate oxidation or any problem affecting or reducing the life of the reinforcement steel or the concrete wall.

Another object of this invention is that the alignment device for the form does not causes cavities in the base of the wall.

These and another objects and advantages of the invention will be obvious during the following description, which includes a series of figures for the preferred embodiments of the invention, which are only for illustrative purposes and are not limitative regarding the teachings of the invention.

BRIEF DESCRIPTION OF THE INVENTION

The device of the invention is a one piece body, mainly made from a plastic resin of the type of high density polyethylene or polypropylene.

The device has a base which defines an essentially flat rectangular base with several holes to allow the pass of concrete and aggregates in such a way that they are in contact with the foundation template; the base also contains several elements to attach the device to such foundation template, such elements include one, two and even three cylinders with one hole along its longitudinal axis to allow the pass of a fastening or anchoring mean, such as nails or screws; the cylinders are preferably arranged in a straight line along the center line of the base; over the long sides of such base, there are vertical parallel walls, which height is short in the central area of the walls, but it rises toward the ends in such a way that their edges establish the lines of contact of the device with the internal walls of the form, when the device is in use; the walls have a series of lateral vertical projections which act as walls or reinforcement structures to avoid the deformation and therefore the deviation of the walls from their vertical position due to the stress applied on them; as it was mentioned before, such walls are parallel one to another and they also have a mirror relation, so either the height as the reinforcement elements correspond to each other, and also are the borders at their edges, which are completely vertical with respect to the base and jointly they establish two vertical planes perfectly parallel to each other, which will be replaced by the inner faces of the form.

The device, as explained hereinafter, have operator's guide and aid elements for its correct positioning and fastening on the layout of the foundation template for walls erection.

DESCRIPTION OF THE FIGURES

For a better understanding of the benefits of the invention device, hereinafter a series of drawings and figures which have the purpose to show in an illustrative way the characteristics of the device, without pretending to be limitative of the same, are disclosed.

DETAILED DESCRIPTION OF THE INVENTION

Figure 1:
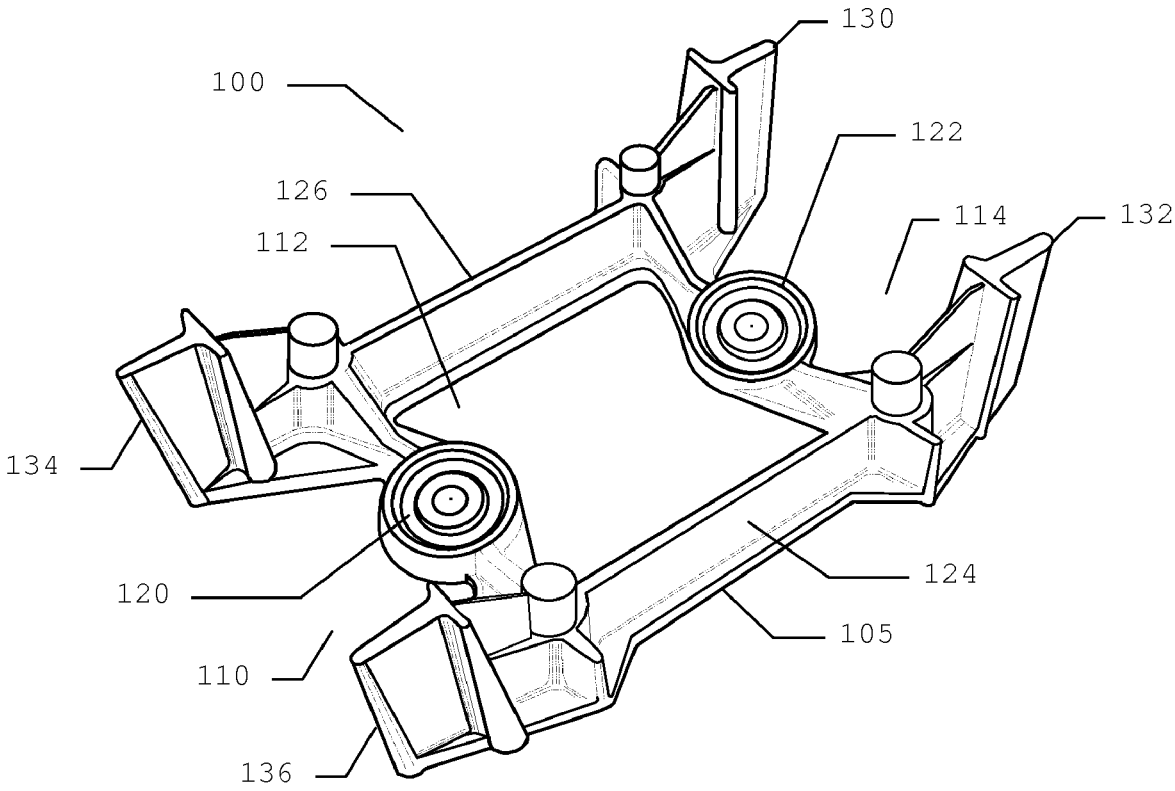
FIG. 1 is a simple perspective view of the first embodiment of the device.
Figure 2:
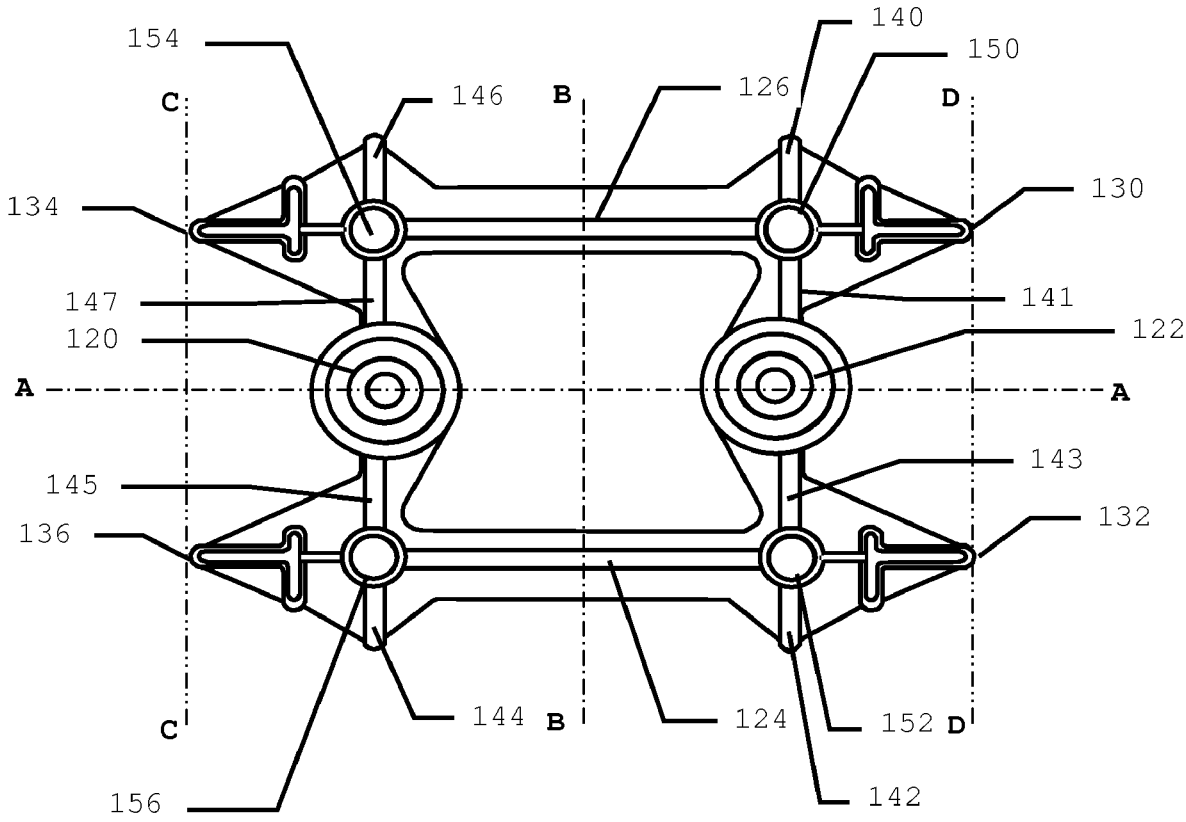
FIG. 2 is an upper side view of the first embodiment of the device.

The following description will refer the above mentioned attached drawings, which shall be understood as illustrative of the preferred embodiments of the invention but not limitative of the scope of the inventive concept. The common elements in the figures have the same numeric references in all of them.

The alignment device for modular forms in concrete walls, referred by numerals (100), (200) and (500) in the following figures, is a device designed to be used as a guide for the installation of panels which will be used as a form or a frame for the fabrication of concrete walls, mainly for the construction of housing or buildings, where first of all, a concrete plate or foundation template is generated, where the layout of the walls distribution is sketched and subsequently, based on such layout, the concrete walls are erected.

Conventionally, "U" shaped chutes are used, which base is firmly fasten to the concrete slab, also known as foundation template, in such a manner that the vertical sides of the "U" are used as a guide for the positioning of the form panels, such walls are susceptible to deformation with the consequent deviation of the form panels; by using the device of the invention (100), (200) or (500), the contact surface between the guide device and the panels is reduced to two lines by side, and due to the configuration of the device, the deformation is basically nonexistent.

The device of the invention (100), (200) or (500) is a single piece body made of a plastic resin, such as high density polyethylene or polypropylene, of the type commonly used in the fabrication of auxiliary devices for construction and it is obtained through an injection molding process.

Making reference first to the device (100) from FIGS. 1-5, this device has a base (105) which defines a flat surface which occupies an essentially rectangular area with several holes (110), (112), (114) to allow the concrete and its aggregates to pass through it, in such a manner that they are in contact with the foundation template (not illustrated) on which the device and subsequently the form structure will be fastened; the base (105) also shows a plurality of fastening elements constituted by two cylindrical bodies (120), (122) with a hole along its longitudinal axis in order to allow a holding or fastening mean to pass through it, such as nails or screws; the cylinders (120), (122) are arranged in a straight line along the central line of the base (105); on the long sides of such base, there are parallel vertical walls (124), (126) which height is short in the central area of the walls, but rises in the ends in such a way that the vertical edges (130), (132), (134), (136) establish the lines of contact of the device (100) with the internal walls of the form, when the device is in use; the walls (124), (126) have a series of lateral vertical projections (140), (141), (142), (143), (144), (145), (146), (147) as reinforcement walls to avoid the deformation and therefore the deviation of the walls (124), (126) from their vertical position due to stress on them before pouring the concrete; such walls have a mirror relation to each other, making the device to be symmetrical with the longitudinal and transversal axis. (lines A-A and B-B from FIGS. 2 and 3, respectively) in such a way that either the heights as the reinforcements (140)-(142)-(144)-(146) and (141)-(143)-(145)-(147) are correspondent in both of them, and also the edges of their sides (130)-(132), (134)-(136), which are completely vertical in relation to the base and which as a group establish two perfectly parallel vertical planes, represented by lines C-C and D-D in FIGS. 2 and 3, which shall be occupied by the inner faces of the form.

The device (100) have a plurality of guide and aid elements (150), (152), (154), (156) for the operator to the correct positioning and fastening on the layouts which are usually sketched in the foundation template for the erection of walls.

Figure 3:
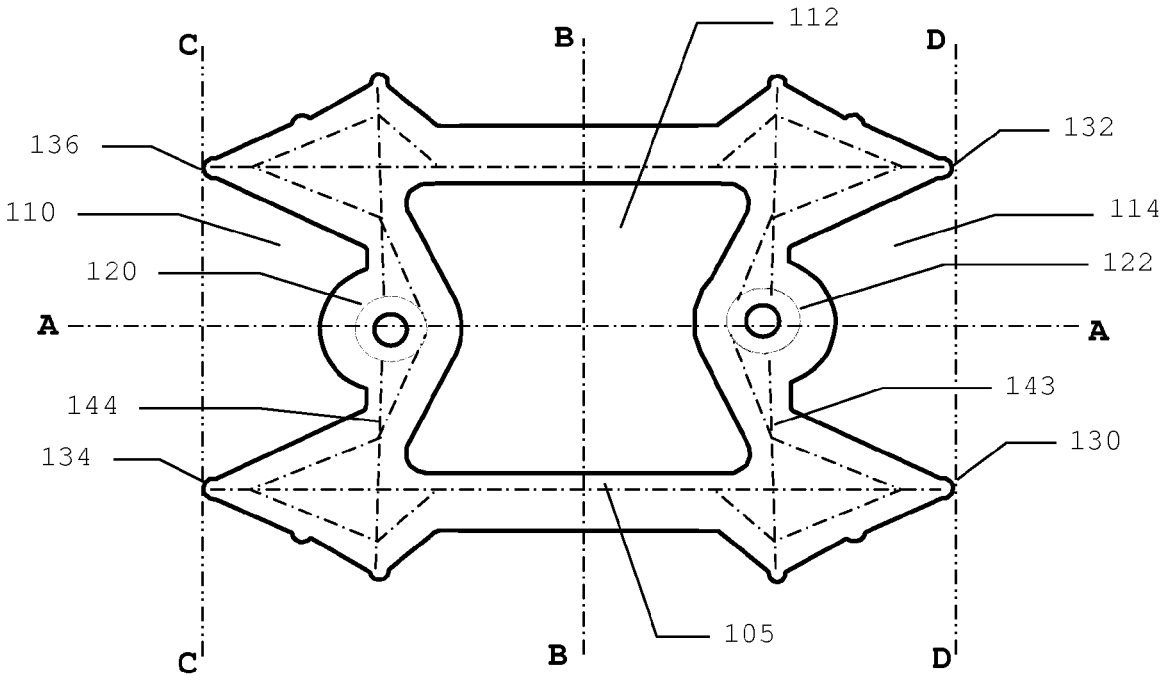
FIG. 3 is a lower side view of the first embodiment of the device.

FIG. 3, a view of the lower plane of the device (100), shows that the areas of contact with the foundation template are minimum, in such a way that the plurality of hollow areas (110), (112), (114) allow the concrete and its aggregates to have a direct contact with the template, assuring the continuity of the material.

Figure 4:
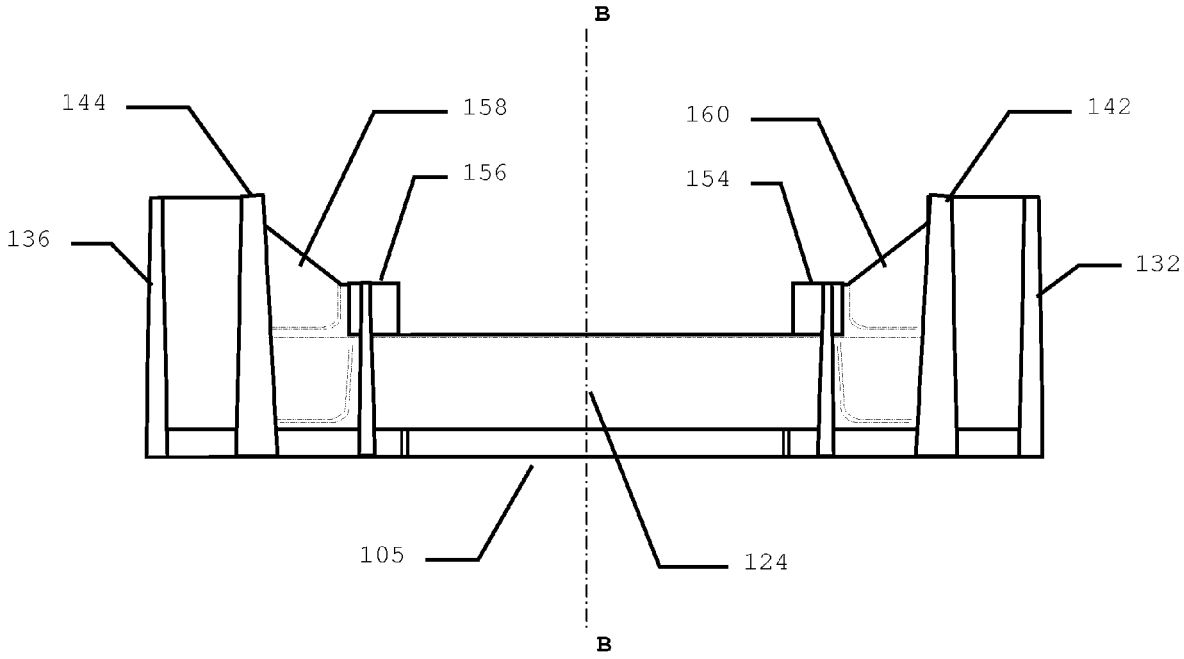
FIG. 4 is a side view of the first embodiment of the device.
Figure 5:
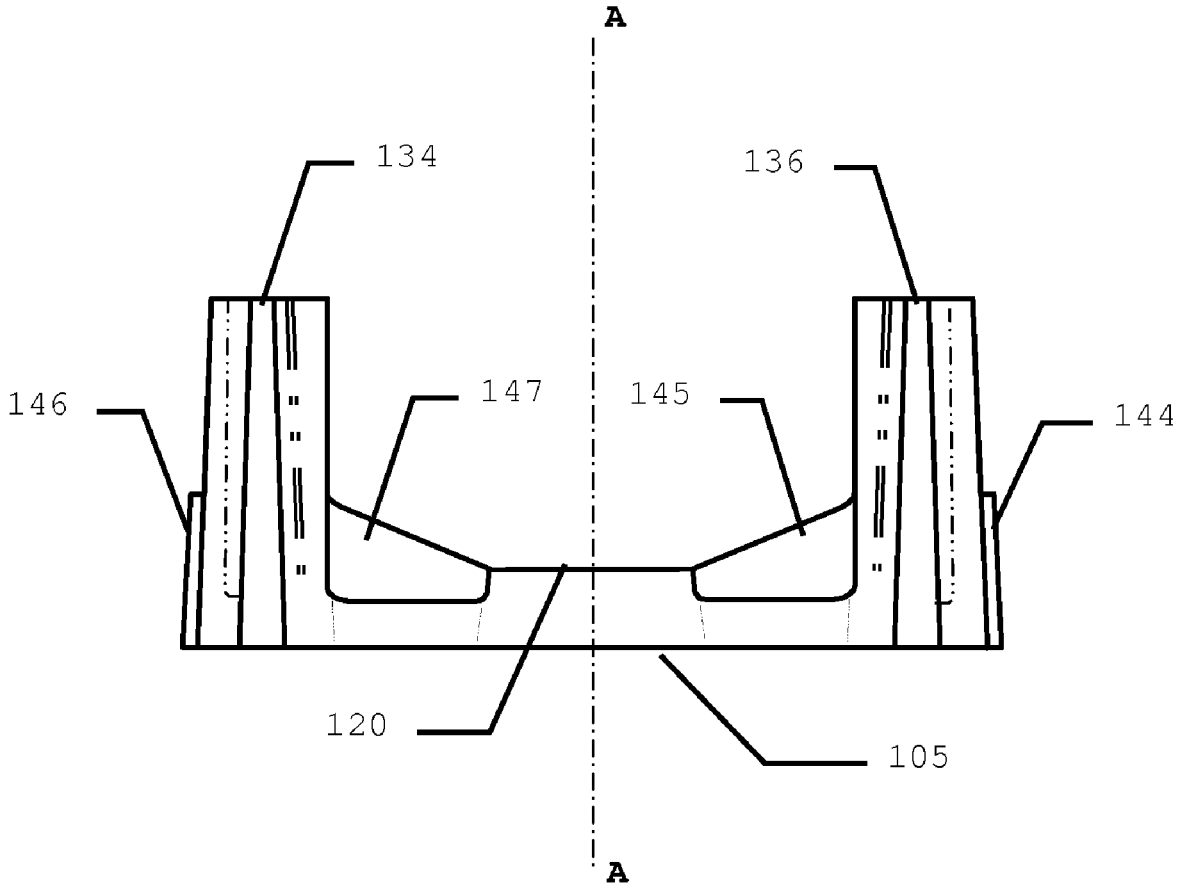
FIG. 5 is a frontal view of the first embodiment of the device.
Figure 6:
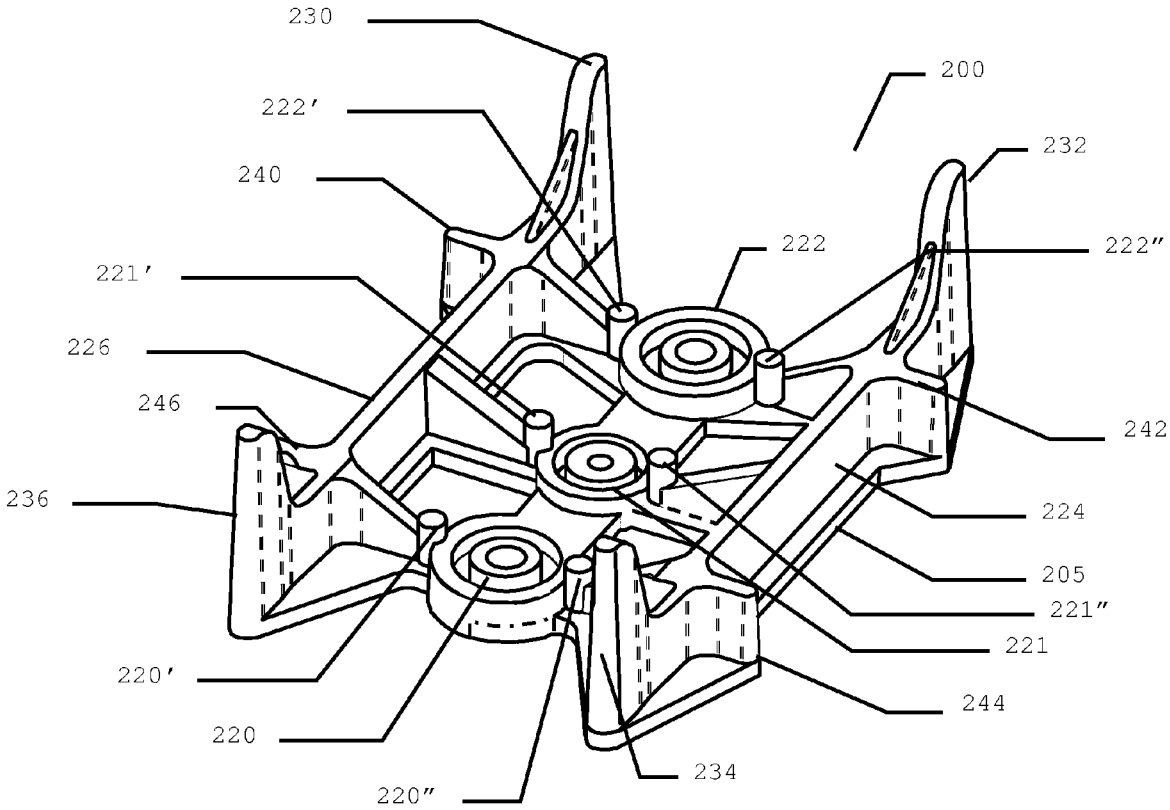
FIG. 6 is a simple perspective view of the second embodiment, preferred, of the device.

FIGS. 4 and 5 show some of the details of the profiles of the device (100), specially it is emphasized the verticality of the edges (130), (132), (134), (136) and it is also possible to see the parallelism between the correspondent of the opposite walls. An additional characteristic of the device (100) is that the height of the edges (130), (132), (134), (136) is comparatively higher than most of the walls (124), (126) and the reinforcement elements (140), (141), (142), (143), (144), (145), (146), (147), although the abutments (158), (160) reinforce the upper ends of said edges (130), (132), (134), (136).

In other preferred embodiment, shown in FIGS. 6 to 12, the device (200) have three fastening areas (220), (221) and (222) which can be used indistinctly, but preferable using the ones on the ends (220) and (222) for fastening; although it is suggested, for a correct positioning the use of the areas on both ends when it is made manually and the central when using a pneumatic gun; if any of the holding devices fails, for example when broken, the remaining fastening elements can be used to guarantee the alignment of the device. It is important to remark that each one of the holding elements (220), (221) and (222) have two cylindrical posts (220'), (220"), (221'), (221"), (222'), (222") which allow the correct alignment when using a pneumatic gun to apply the holding nails.

Figure 7:
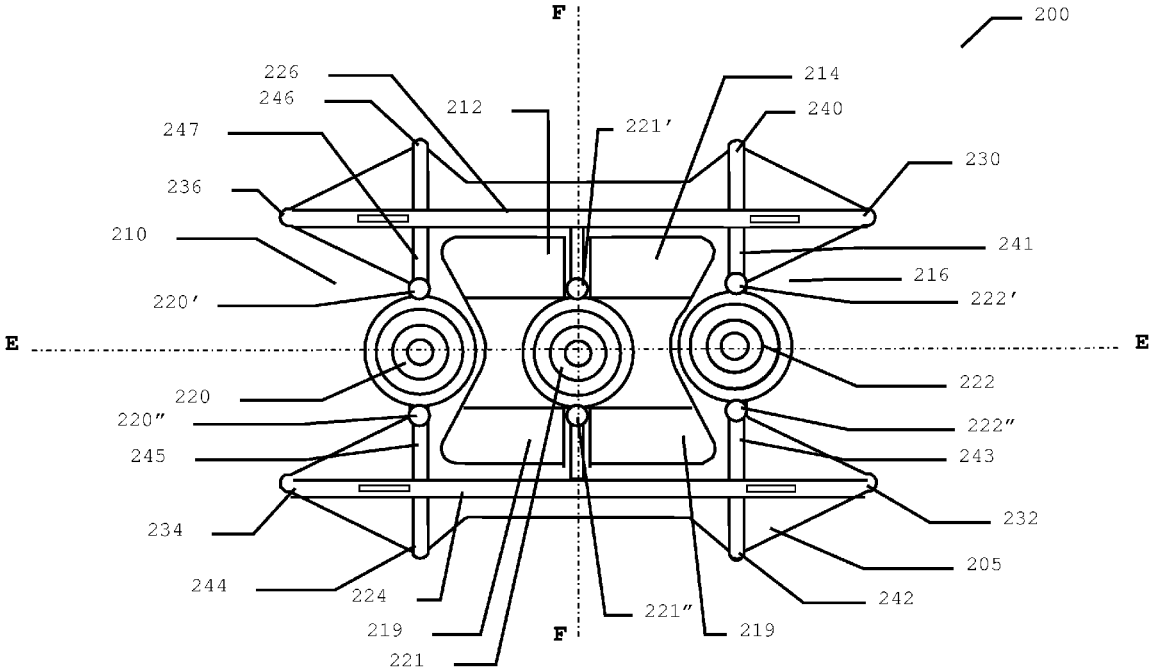
FIG. 7 is an upper side view of the second embodiment of the device.
Figure 8:
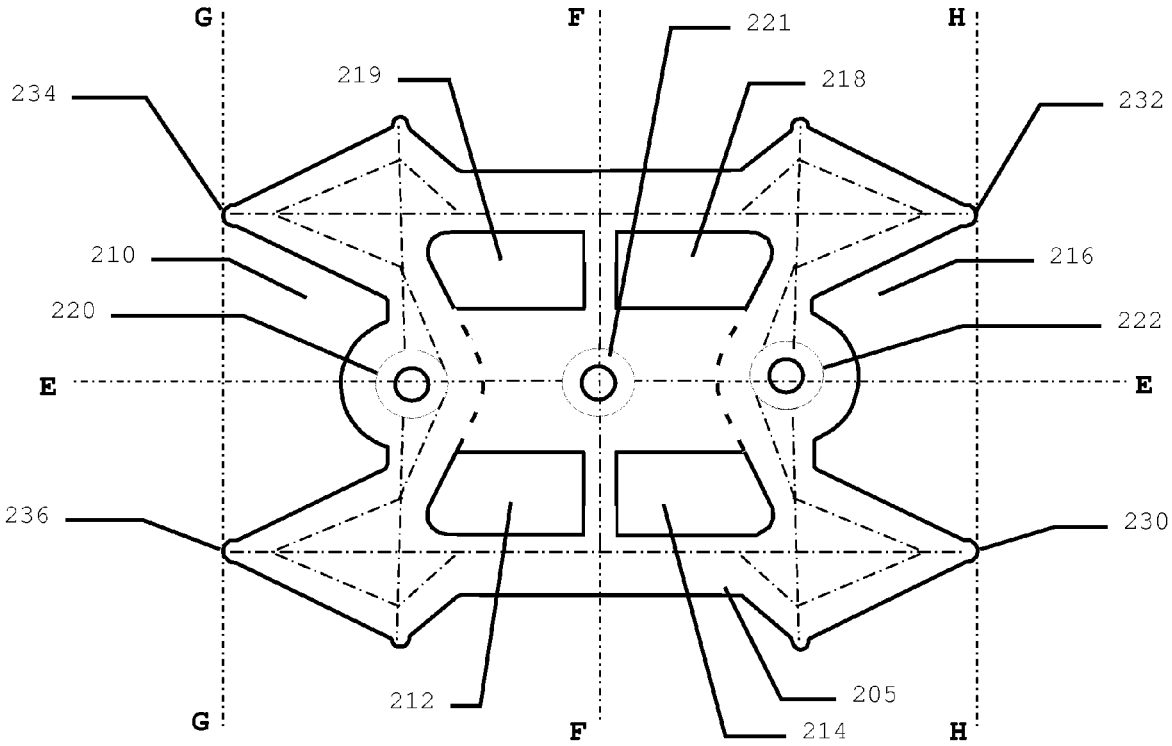
FIG. 8 is a lower view of the second embodiment of the device.

Besides the central holding area (221) and the alignment posts (221') y (221"), the device (200) have homologous elements to the embodiment with two holding areas above mentioned: a base (205) which defines a flat surface ocupying an essentially rectangular space with several holes (210), (212), (214), (216), (218) and (219) to allow the pass-through of concrete and its aggregates in such a manner that they can have contact with the foundation template on which the device and the form structure will be mounted; the base (205), as explained before, have three elements (220), (221), (222) to fasten the device to such foundation template, and such elements are constituted by cylindrical bodies with a hole through them to allow the access of a fastening device such as nails or screws; the cylinders (220), (221), (222) are arranged in a straight line along the center line of the base (205); over the long sides of such base, there are parallel vertical walls (224), (226) which height is short in the central area of the walls, but which rises towards the ends in such a way that its vertical edges (230), (232), (234), (236) determine the contact lines of the device (200) with the inner walls of the form when the device is in use; the walls (224), (226) have a series of vertical lateral projections (240), (241), (242), (243), (244), (245), (246) and (247) as reinforcement walls to avoid the deformation and therefore the deviation of the walls (224), (226) from their vertical position, due to stress acting over them before pouring the concrete; such walls have a mirror relation to each other, making the device to be symmetrical with respect to its longitudinal and transversal axis (lines E-E and FF in FIGS. 7 and 8 respectively), in such a manner that either the heights and the reinforcements (240)-(242)-(244)-(246) and (241)-(243)-245)-(247) correspond to each other, and also do the edges of their ends (230)-(232), (234-(236), which are completely vertical in relation to the base and jointly establish two perfectly parallel vertical planes, represented by lines G-G and H-H in FIGS. 7 and 8, which shall be occupied by the inner faces of the form.

The device (200) has a plurality of guide and aid elements (220'), (220"), (221'), (221"), (222') and (222") for the correct positioning of a pneumatic gun and for the fastening over the layout which are usually sketched in the foundation template of a construction to erect walls.

FIG. 8, a bottom view of the device (200), shows the contact areas of the template with the concrete, as well as the hollow areas (210), (212), (214), 25 (216), (218) and (219) which allow the concrete and its aggregates establish direct contact with the template, assuring the continuity of the material.

Figure 9:
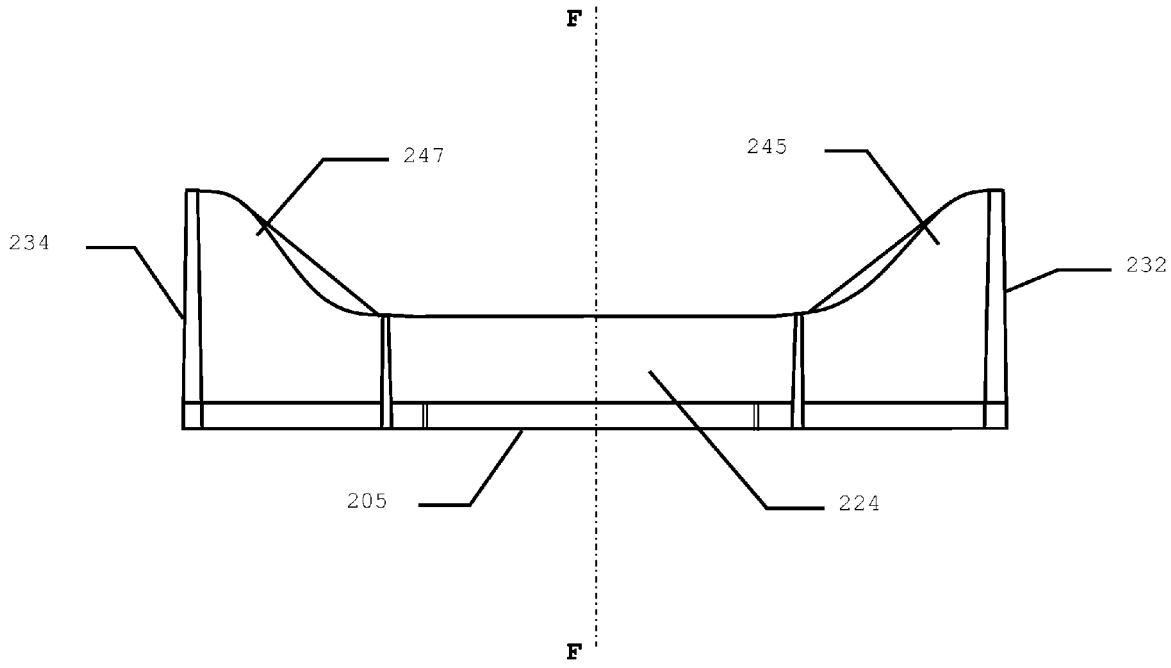
FIG. 9 is a side view of the second embodiment of the device.
Figure 10:
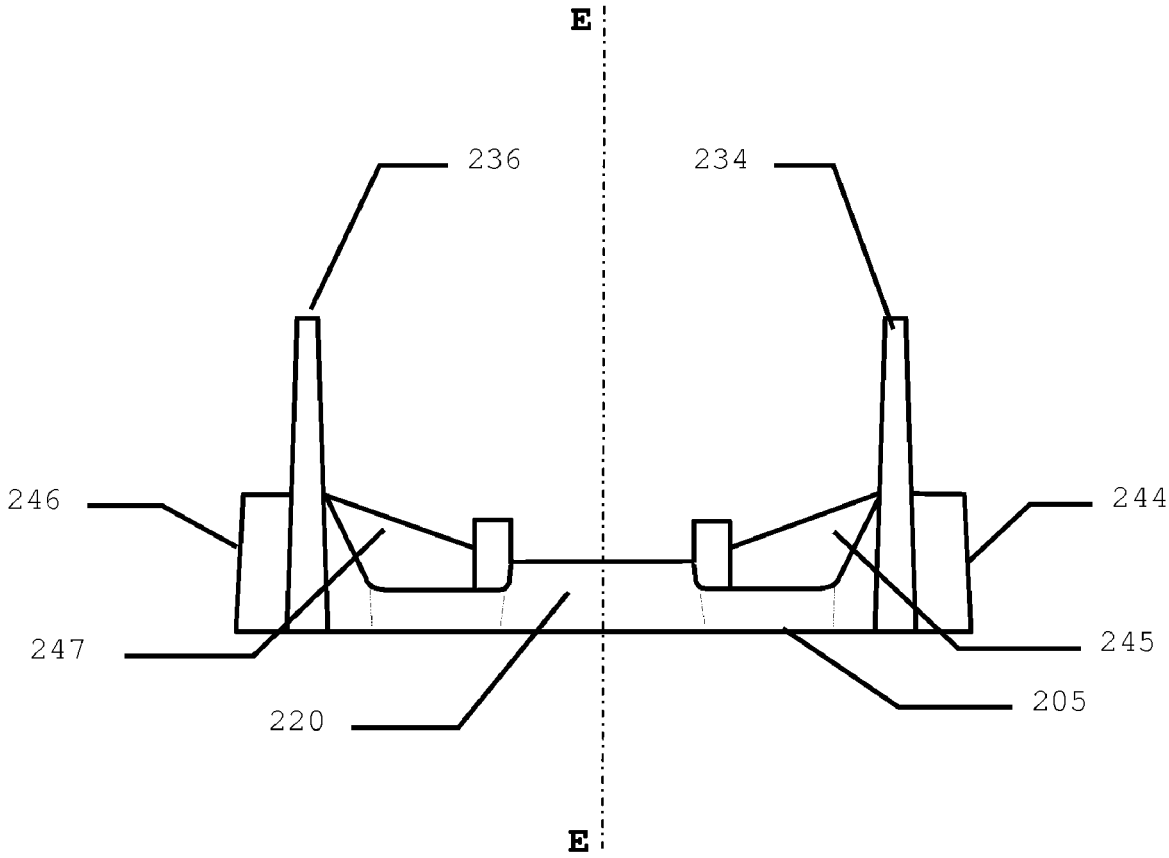
FIG. 10 is a frontal view of the second embodiment of the device.

FIGS. 9 and 10 show some details of the profiles of the device (200) specially it is emphasized the verticality of the edges (232), (234) and it is noticeable also the parallelism among the corresponding on the opposite walls, as above mentioned for the first embodiment. As well as in the first embodiment, the height of the edges (230), (232), (234), (236) is comparatively higher than the walls (224), (226) and the reinforcement elements (240), (241), (242), (243), (244), (245), (246), (247).

Figure 11:
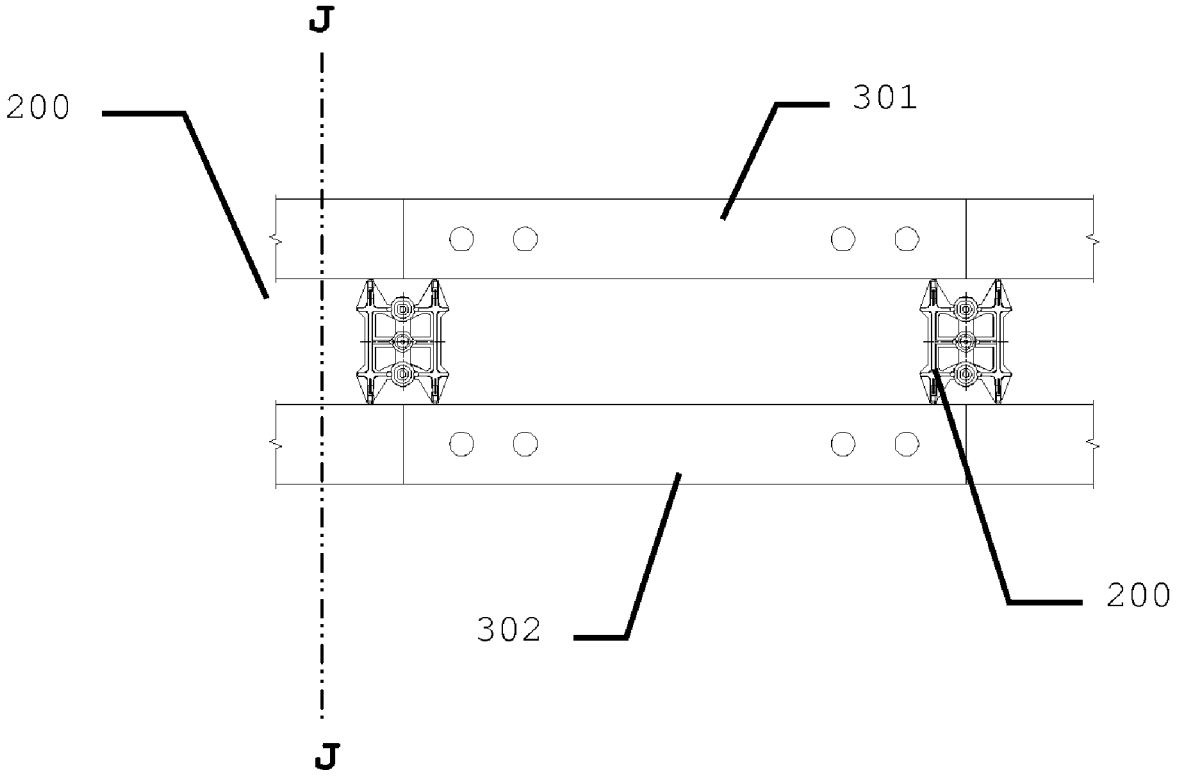
FIG. 11 is a schematic view of a pair of devices of the invention, in their position of use, with two parallel form elements for the fabrication of a concrete wall with a constant thickness on a layout.

The configuration of any of the embodiments of the device object of this invention (100), (200) or (500), which will be described hereinafter, allows the operator to fasten with nails preferably with the use of a pneumatic gun (in such case, preferably using only one nail in the center), at least two of these devices along the layout for a wall, as it is schematically shown in FIG. 11 with two elements of the (200) type, in order to align in a parallel way, two "walls" of the form or mold (301), (302) in such a way that the planned thickness of the wall, corresponding to the length of the device, can be guaranteed in the stretch between the two guide devices; the material and the dimensions of said form are used as a base to define the space between the devices (100), (200) or (500).

Figure 12:
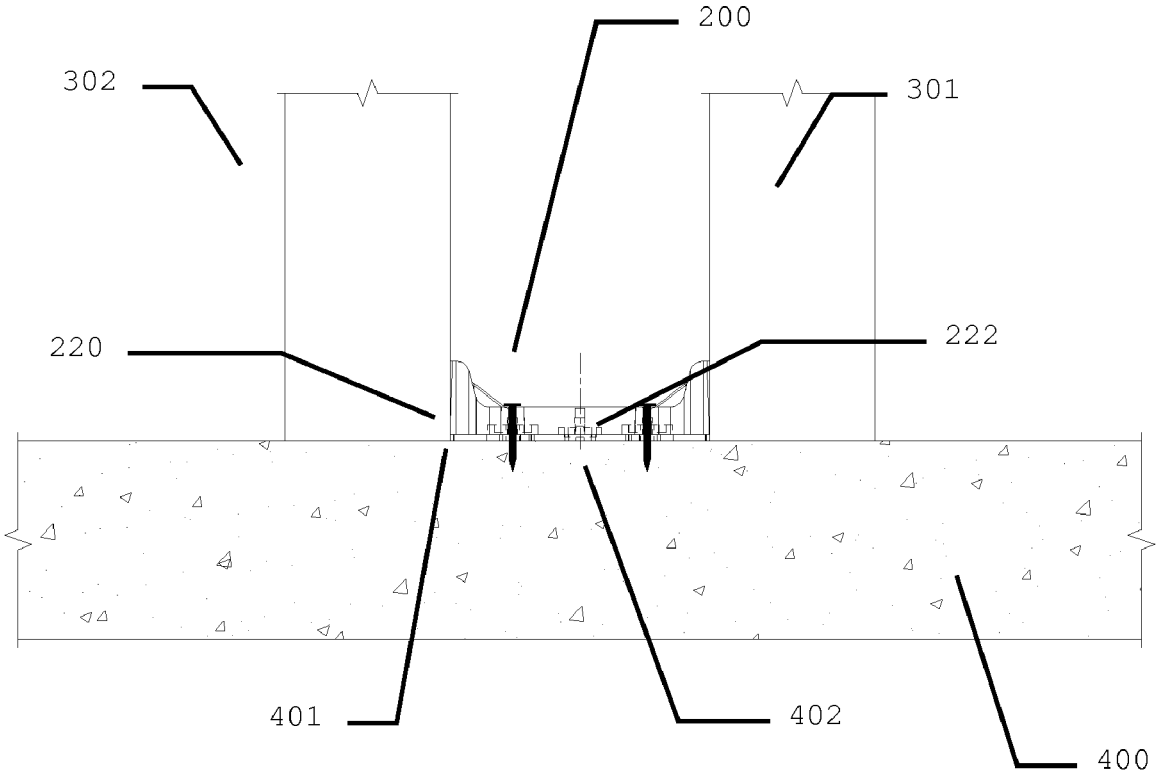
FIG. 12 is a schematic representation of a sectional view along the J-J line of FIG. 11.

In FIG. 12 it is shown an schematic representation of a transverse sectional view along the J-J line of FIG. 11, showing how the fastening means (401), (402) referred to as nails or screws, pass through the device (200) taking as an example, at the fastening points (220) and (222) located at the ends, and reaching the floor plate (400), fastening in such a way the device in place, in such a manner that the walls of the form or molds (301) and (302) are erected in a vertical and parallel manner one in front of the other, fitting to the vertical lines of the walls (230), (232), (234) and (236) (as shown in the previous figures).

Each embodiment offers unique advantages for the alignment of the form, since the use of only two fastening points allows to assure the alignment, preventing the unnoticed rotation of the device (100) or (200), while when having three points (the embodiment referred as (200)) also helps the installer when the surface of the slab have areas with imperfections or shows protuberances, placing the holding mean, in the easiest place to access.

Regarding the manufacturing materials of the device (100), (200), it has already mentioned that it is preferred to use plastic resin of common use for the technical field, such as, but not limited to, high density polyethylene or polypropylene, the advantage of using these kind of materials is to avoid possible damages to the inner walls of the form, since this accessory will be used for modular form; this kind of form always have a metallic core, and the face contacting the device (100), (200) or (500) can be made of steel, aluminum or wood, or even of different plastic resins, 100% made of plastic and others with a metallic core.

For the correct alignment of one or both walls of the form using the device, it is recommended to:

1) Sketch the layout, this is, a distribution of the walls to be poured in site, on the foundation template;

2) Establish which walls of the sketched walls will be poured in site and therefore require alignment;

3) Since the device is designed to guarantee the alignment of the walls at a distance equal to the length of the vertical walls, it is necessary to select the suitable size of the devices, according to the thickness of the walls to be poured;

4) Fasten a plurality of devices for the alignment of the forms to such template, in such a way that there are at least two points of support for each section or stretch of the form or mold, preferably for the two ends of such section and;

a) For each side of the wall to be poured, the imaginary plane on the short side of the device's base, shall match with the line of the inner face of the section of the form or mold to be aligned;

b) Preferably, the union line between two sections of the form shall match with the largest symmetry axis of the device in such a manner that the edge of one of the vertical walls can be used to align a section of the form or mold and the edge of the parallel vertical wall of the device can be used to align the section adjacent to the first one;

c) When using the embodiment of the device with two holding elements available, preferably there will be used the most distant two holding elements; if using the embodiment of the device with one central holding element, it can be choosen to use only this one element, or if some of the alternate elements is broken, the central one can be used as an auxiliary element;

d) the recommended holding devices to fasten the device shall be appropriate for the material of the foundation template, including nails or screws, using the necessary tools or equipment including a pneumatic gun.

5) Place the required walls of the form, on the layout, in such a way that the lower edges of the inner faces match with the corresponding sketch, and the lines in contact with the fasten devices are totally matched with the vertical edges of the vertical walls.

6) Fasten the walls of the form in place.

7) Proceed with the pouring of the wall.

It is evident that the fasten devices will be embedded in the concrete, which may be linked to the foundation around the device and through the hollow areas designed for such purpose in the base of the device. Also it is clear that the area of contact of the device with the inner face of the form or mold is reduced to a very fine line which corresponds to the rounded edge of the vertical ends of the vertical walls, so they will be basically invisible when striking the centers of the wall.

In brief, the advantages of the device object of this invention regarding the devices in the prior art are:

a) the areas of contact with the inner face of the form are reduced to a minimum, there will be only a pair of very fine, short lines at each side of the walls for each guide device used, b) the parallelism among the inner faces of the form (and finally the external faces of the finished wall) is guaranteed when the four contact lines of the corresponding faces of the two parallel fixed devices are fully satisfied;

c) the holes in the base of the device allow the concrete and its aggregates to have contact with the surface of the template even in the area occupied by the device, d) the series of reinforcement elements reduce the possibility of deformation of the device or non-alignment of the contact lines, and therefore, they reduce the possibility of an alteration of the design thickness of the concrete wall.

Figure 13:
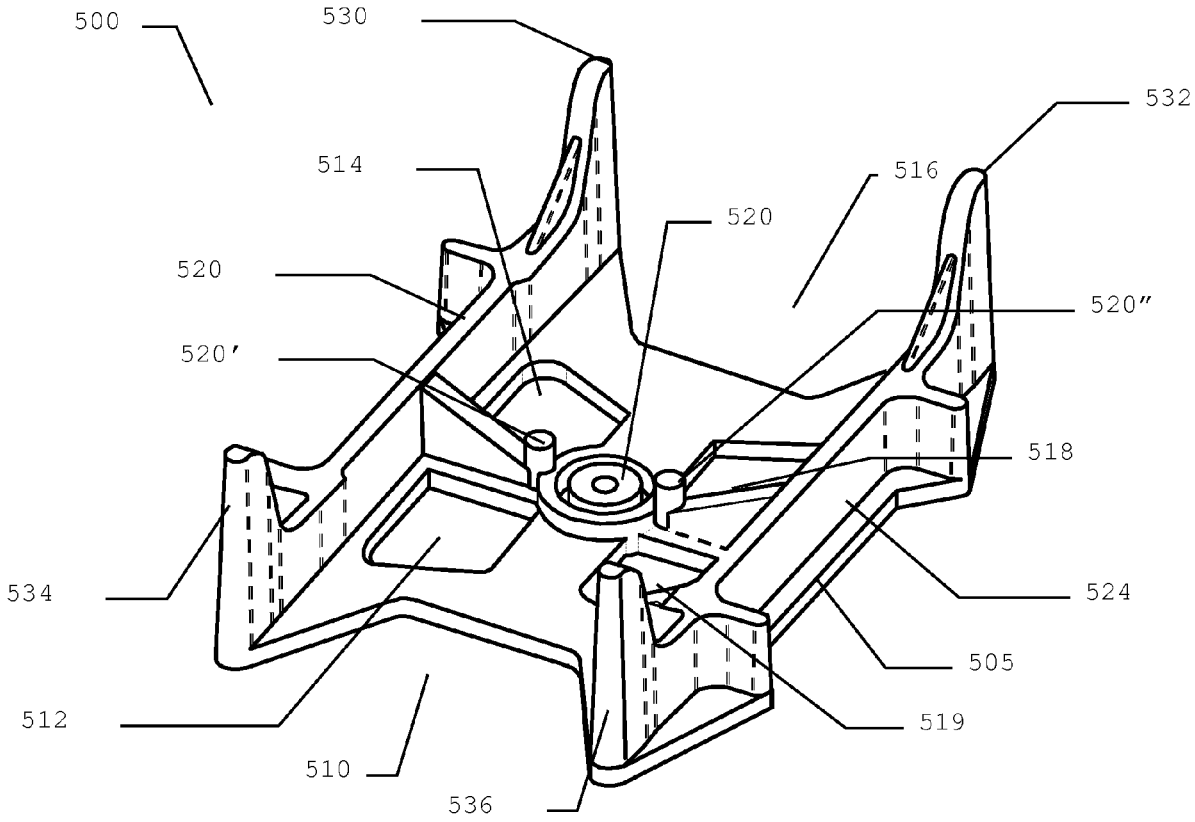
FIG. 13 is a simple perspective view of the third embodiment of the device.

Although the previous description of the device refers two preferred embodiments, it is evident for a person with knowledge in the technical field that some modifications to the basic configuration of these embodiments may be necessary in order to satisfy any particular requirements, but it shall be considered that these modifications will not take the device beyond the scope of the subsequent claims; for example, one of this possible modifications is shown in FIG. 13, a device (500) with only one central holding point (510), integrating many of the advantages of the above mentioned invention, and whose elements which are homologous to those of the other two embodiments, for example, the essentially rectangular base (505), the lateral vertical walls (524) and (526), the hollow areas (510), (512), (514), (516), (518) and (519), the only cylindrical holding point (520) and its support cylinders and guide (520') and (520"), which are all the most relevant elements of the device.

Once the invention was described, which is considered new and therefore its property is claimed, is the following:

1. A device for the alignment of form or mold structures for the pouring of concrete walls of the kind which comprises:

a base with a plurality of hollow areas to permit the pass of the concrete and its aggregates, defining an essentially rectangular surface with a flat side to put into contact with a foundation template;

at least one element to fasten the device in pre-established locations according to a layout on a foundation template; a plurality of auxiliary guides;

parallel vertical walls over the long sides of such base; and reinforcement elements transverse to said vertical walls to reinforce them;

wherein:

i) the at least one element to fasten the device to the template having a body essentially cylindrical, with short height and a central hole to allow the access of a holding or fastening mean, and having a configuration and size which allow to accommodate the head of a pneumatic gun or other tool to place properly fastening means to fasten the device to a founding template;

ii) the height of the vertical walls is short and constant in the central area of the device and substantially increase near their ends, and said vertical walls have a plurality of abutments, as reinforcement projections which are erected from the base up to the upper edge of such walls;

iii) the edges at the ends of the vertical walls are perpendicular and are aligned by pairs to define vertical parallel planes matching with each short side of the base;

iv) the length of any of the two vertical walls between the vertical edges, establishes the distance between the inner faces of the forms or mold walls and therefore, the thickness of the concrete wall.

2. The device according to claim 1, wherein the height of the transversal reinforcement elements is gradually reduced from that of the vertical walls at the union with them, to match the height of the fastening cylindrical elements.

3. The device according to claim 1, wherein the auxiliary guides used as visual guides for the positioning of the device are located over the vertical walls at the point where they cross with the reinforcement transversal elements, and those used as support for the head of the pneumatic gun are located in the union points of the transversal elements with the cylindrical fastening elements.

4. The device according to claim 1, wherein it has only one fastening element for the device, such fastening element being located in the geometrical center of the base.

5. The device according to claim 1, wherein it has two fastening elements for the device, such fastening elements being located over the greater symmetry axis of the base, equidistant from the geometric center of the base and between such geometric center and the imaginary line which establishes the short sides of the base.

6. The device according to claim 1, wherein it has three fastening elements for the device, one of such holding elements is located at the geometric center of the base and the other two fastening elements are equidistant between the geometric center of the base and the imaginary line establishing the short sides of the base.

* * * * *